US008523392B2

(12) United States Patent
Hoover et al.

(10) Patent No.: US 8,523,392 B2
(45) Date of Patent: Sep. 3, 2013

(54) LED MINE LIGHT

(75) Inventors: Brandon C. Hoover, Cornelius, NC (US); Daniel R. Seymour, Mooresville, NC (US); James M. Burry, Troutman, NC (US)

(73) Assignee: BISS Product Development LLC, Mooresville, NC (US)

( * ) Notice: Subject to any disclaimer, the term of this patent is extended or adjusted under 35 U.S.C. 154(b) by 550 days.

(21) Appl. No.: 12/421,277

(22) Filed: Apr. 9, 2009

(65) Prior Publication Data

US 2009/0256500 A1 Oct. 15, 2009

Related U.S. Application Data

(60) Provisional application No. 61/123,432, filed on Apr. 9, 2008.

(51) Int. Cl.
*F21V 21/00* (2006.01)

(52) U.S. Cl.
USPC ..... 362/249.02; 362/287; 362/363

(58) Field of Classification Search
USPC ..... 362/109, 186, 191, 197, 202, 205, 362/208, 249.02, 269, 287, 363, 398, 430, 362/800
See application file for complete search history.

(56) References Cited

U.S. PATENT DOCUMENTS

| | | | | |
|---|---|---|---|---|
| 4,425,602 | A * | 1/1984 | Lansing | 362/186 |
| 5,228,686 | A * | 7/1993 | Maleyko | 473/570 |
| 5,537,111 | A * | 7/1996 | Martin et al. | 340/983 |
| 6,076,946 | A * | 6/2000 | Brouillette et al. | 362/362 |
| 6,663,260 | B1 * | 12/2003 | Tieszen | 362/249.06 |
| 6,877,880 | B2 * | 4/2005 | Endo | 362/282 |
| 6,923,550 | B2 * | 8/2005 | Lee | 362/191 |
| 7,364,319 | B2 * | 4/2008 | Canella | 362/158 |
| D577,456 | S * | 9/2008 | Schwendinger et al. | D26/72 |
| 2002/0135999 | A1 * | 9/2002 | Chen | 362/116 |

* cited by examiner

*Primary Examiner* — Hargobind S Sawhney
(74) *Attorney, Agent, or Firm* — Hammer & Associates, P.C.

(57) ABSTRACT

An LED light device has a generally spherical body with a a plurality of projections radiating outwardly therefrom, each of said projections having a distal end and at least one of said projections has a magnet at its distal end. The body encloses a power source and carries at least one LED light aimed outwardly therefrom. The device has the appearance of a spiked military water mine.

5 Claims, 2 Drawing Sheets

LED MINE LIGHT

FIELD OF THE INVENTION

The present invention relates to a battery operated light. More particularly, the present invention relates to an generally spherical LED light having the appearance of an antique water mine with multiplicity of magnetic tipped horns which provide a multiplicity of attachment locations points and hence a multiplicity of lighting directions.

BACKGROUND OF THE INVENTION

Flashlights, drop lights and other battery operated lights are often used and are well known. The use of LED (light emitting diode) components in such battery operated lighting devices is also well known. However, it is typical of users of such lights to require them while working in tight, confined, low-light, night time, or power-out conditions and their remains room for improvement in such devices. There also remains room for improvement in the aesthetics of such devices.

Often users of such lights have a difficult time holding the flash light or drop light at the desired angle in order to properly illuminate the work area. It is also often difficult to fit a flash light or drop light in many very tight and cramped work areas. Thus, it would be desirable to have a light which could be used in tight and cramped work areas and which had means for facilitating its positioning or attachment to a supporting structure and further had means for facilitating its aiming in a multiplicity of directions.

The present invention provides a "hands free" LED light that enables its users to aim the direction of light and accurately illuminate their work areas. The appearance of the product of the present invention resembles a conventional spiked military naval military mine although the size of the product of the present invention will usually be relatively small. The light of this invention has a plurality of spikes or horns, the tips of which are well adapted for carrying a magnet. The light of this invention has a generally spherical body with the plurality of spikes extending radially outwardly therefrom, with the spikes extending in many different directions and at different angles from the spherical body which carries at least one LED light source. The user can magnetically attach the light to any ferromagnetic surface and easily aim the light at their work area using one of the many magnetic spikes. The spikes also serve as positioning legs enabling the user to position the light in various directions on flat surfaces. The spikes also keep the product from rolling even if it is placed on a non-magnetic surface and still permit the light to be aimed in different directions.

The LED mine light of the present inventions has many desired features which will be useful to end users in low light situations. It does not require the user to carry an additional outside power source. It creates a brightly lit work area and the ability to accurately aim the light and magnetically attach to ferromagnetic surfaces. It is also aesthetically pleasing and, to some extent, has the appearance of a novelty item. These and other advantages will be appreciated by those skilled in the art from the accompanying drawings taken in conjunction with the following specification and claims.

SUMMARY OF THE INVENTION

An LED light device has a generally spherical body with a a plurality of projections, referred to herein as horns, radiating outwardly therefrom, each of said horns having a distal end and at least one of said horns having a magnet at its distal end. The body encloses a power source and carries at least one LED light aimed outwardly therefrom.

DESCRIPTION OF THE INVENTION

Figure 1:
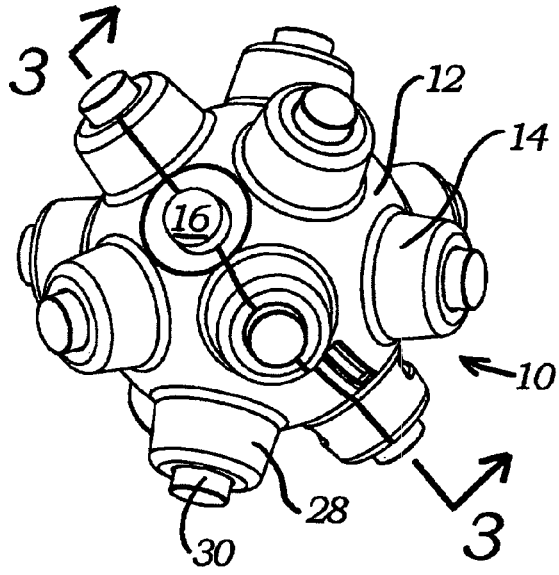
FIG. 1 is a front perspective view of a preferred embodiment of a LED mine of the present invention.
Figure 2:
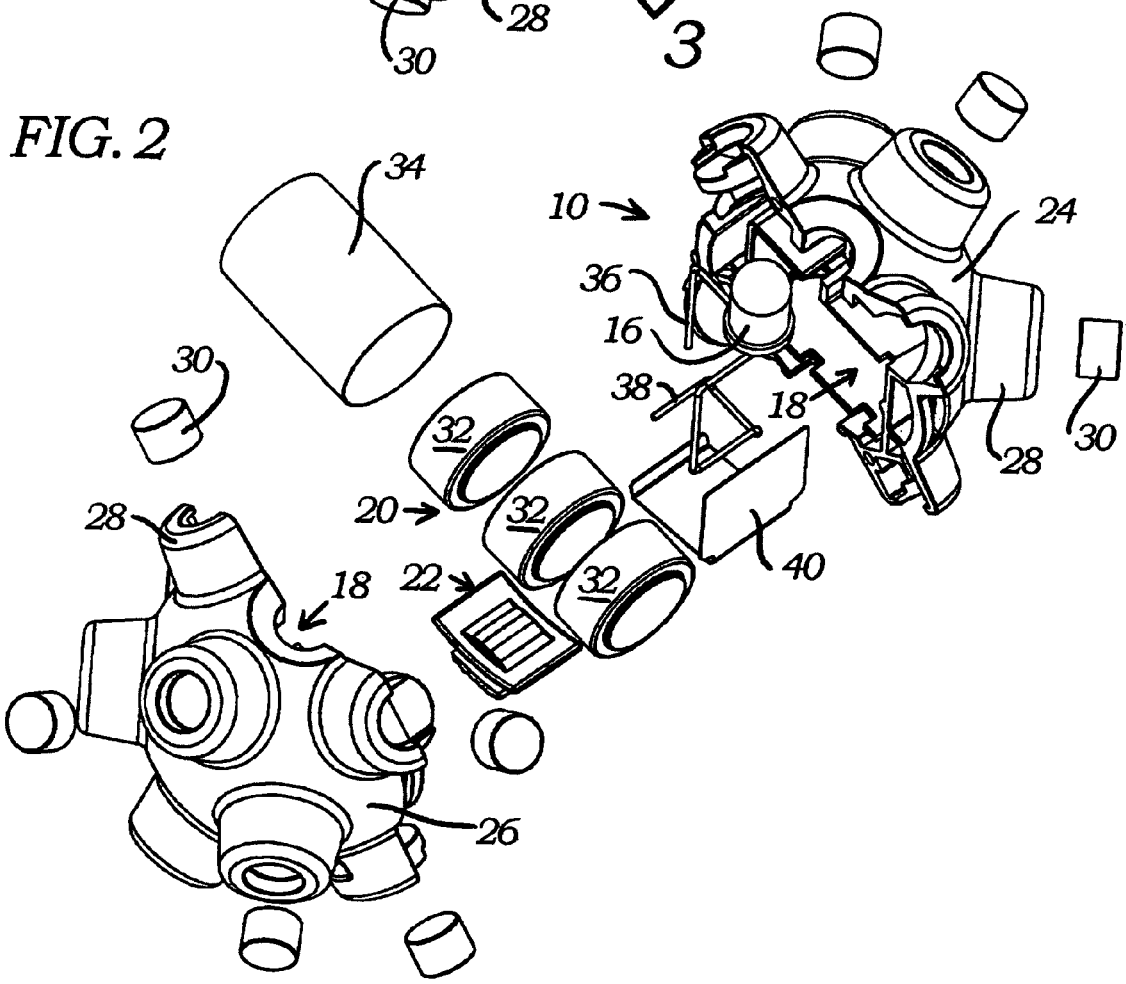
FIG. 2 is an exploded view of the mine of FIG. 1.
Figure 3:
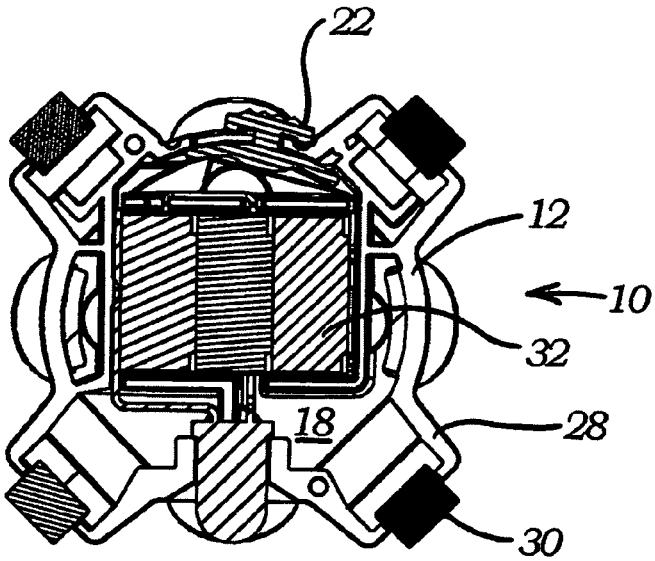
FIG. 3 is a cross-sectional view of the mine taken along line 3-3 in FIG. 1.

Now referring to FIGS. 1-3, an LED mine light of the present invention is shown and indicated generally by the numeral 10. Mine light 10 broadly comprises a generally spherically shaped body 12 with a plurality of projections or horns 14 radiating outwardly therefrom. Body 12 of mine light 10 carries an LED 16 whose light output is directed outwardly therefrom, and a has a hollow interior 18 for containing an electrical battery power source 20 and an electrical switch 22 for connecting battery power source 20 to the LED 16.

As is best shown in FIG. 2, body 12 of LED light mine 10 is generally spherical and comprises a first hemisphere 24 and a second hemisphere 26. Each hemisphere 24 and 26 has a plurality of horns 14 projecting radially outwardly therefrom. Each horn 14 is preferably equally spaced from each other horn 14 with twelve horns 14 being illustrated in the Figures. It will, of course, be appreciated that more or less than twelve horns can be suitably used and such variations in the numbers of horns 14 are intended to be within the broad scope of this invention. Each horn 14 has a distal end 28 which has a magnet 30 glued or otherwise fastened thereto. Of course, it may be desired to have some horn 14 which do not have magnets 30 attached thereto and such modification of the light mine 10 shown in the Figures is intended to be within the broad scope of this invention. Each magnet 30 can be molded or otherwise attached to each horn 14. As shown in the preferred embodiment of FIGS. 1-3, each horn 14 is generally cylindrical, i.e., circular in cross-section but, of course, other projection shapes for horns 14 will be apparent to those skilled in the art and such other shapes are intended to be within the broad scope of the present invention. Body 12 of LED light mine 10 can be made of plastic, rubber or any other suitable material. Suitable materials can be transparent, semi transparent or opaque material. The material can be molded and can be hard or soft. The mine can be made watertight for underwater applications.

Hemispheres 24 and 26 enclose hollow interior 18 which is intended to house or contain a suitable power source 20 for the LED 16 as well as the required electrical connectors between the power source and the LED. As illustrated in the figures a suitable power source 20 can be button batteries 32 in tubular battery holder 34.

The LED 16 is turned on and off by the user manipulating power switch 22 which is electrically connected to leads 36 and 38 of LED 16 and to switch plate 40 in a conventional manner. A lanyard (not shown in the Figures) can be attached to an aperture (not shown in the Figures) if desired.

Figure 4:
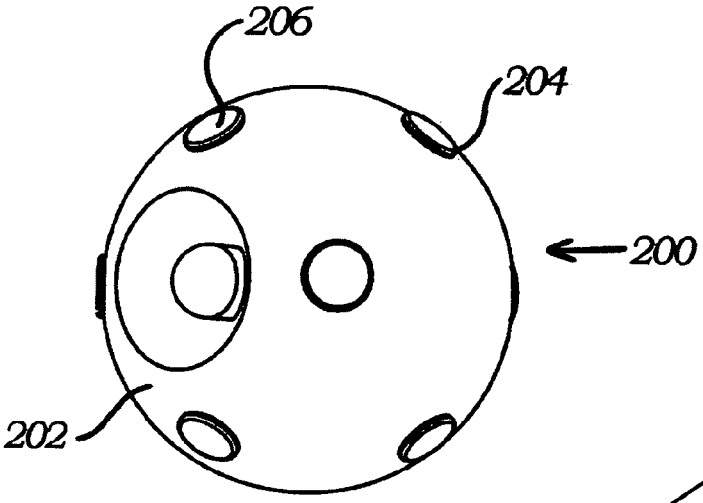
FIG. 4 is a front perspective view of another embodiment of a LED mine light of the present invention.

Now referring to FIG. 4, an alternative preferred embodiment of the present invention is shown and indicated generally by the numeral 200. LED mine light 200 is similar to light 10 but has body 204 with magnets 204 substantially flush with the exterior surface of body 204. Thus, light 200 does not have horns extending therefrom.

Figure 5:
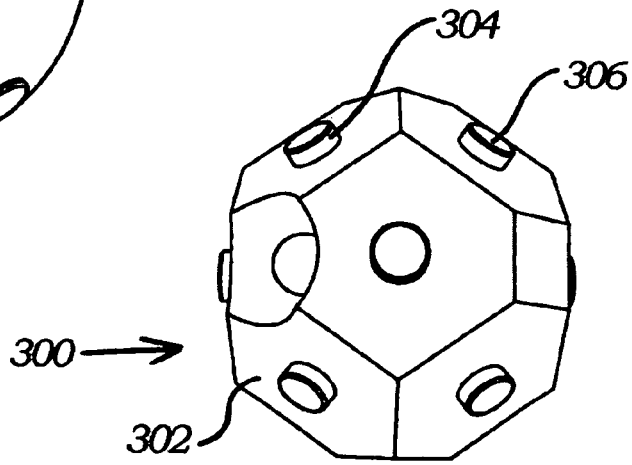
FIG. 5 is a front perspective view of yet another embodiment of a LED mine light of the present invention.

Now referring to FIG. 5, yet another alternative preferred embodiment of the present invention is shown and indicated generally by the numeral 300. LED mine light 300 has body 302 which is a generally symmetrical geometric figure but has a plurality of flat surfaces thereon. Projections or horns 304 are tipped with magnets 306.

While preferred embodiments of the present invention have been disclosed and described above, it will be appreciated by those skilled in the art that the present invention is subject to modifications and variations and such modifications and variations are intended to be within the broad scope of the present invention. For example, conventional lamps or other light sources could be substituted for the LED components. Also, the body can be transparent, semi-transparent or opaque and can be made of various materials such as thermoplastic or thermoset polymeric materials so long as the material used is consistent with the function of the part made therefrom.

What is claimed is:

1. An LED light device having a generally symmetrical body, said body enclosing a power source and carrying at least one LED light aimed outwardly therefrom, said body having a general shape of a sphere with a plurality of horns extending outwardly therefrom, each of said horns having a distal end and extending beyond said sphere and at least one of said horns having a magnet at its distal end;

wherein said horns are generally cylindrical projections and said horns are equally spaced about said body each said horn has a cylindrical diameter and each said magnet on said horn has a cylindrical shape with a cylindrical diameter smaller than the cylindrical diameter of said horn.

2. An LED light device as in claim 1, wherein each distal end of each of said horns has a magnet thereon.

3. An LED light device as in claim 1, wherein said body has 12 horns.

4. An LED light device as in claim 1, wherein said body is comprised of molded thermoplastic material.

5. An LED light device as in claim 1, wherein said device has an electrical switch for controlling said LED light.

* * * * *